US010641471B1

(12) United States Patent
Ruggiero

(10) Patent No.: US 10,641,471 B1
(45) Date of Patent: May 5, 2020

(54) RETRACTABLE HOLIDAY LIGHTS

(71) Applicant: Thomas A. Ruggiero, Merritt Island, FL (US)

(72) Inventor: Thomas A. Ruggiero, Merritt Island, FL (US)

( * ) Notice: Subject to any disclaimer, the term of this patent is extended or adjusted under 35 U.S.C. 154(b) by 67 days.

(21) Appl. No.: 15/983,467

(22) Filed: May 18, 2018

(51) Int. Cl.

| | |
|---|---|
| ***F21V 21/15*** | (2006.01) |
| ***F21S 8/04*** | (2006.01) |
| ***F21V 23/00*** | (2015.01) |
| ***H05B 37/02*** | (2006.01) |
| ***G09F 23/00*** | (2006.01) |
| ***G09F 27/00*** | (2006.01) |
| *G09F 9/33* | (2006.01) |
| *F21W 121/00* | (2006.01) |
| *F21Y 115/10* | (2016.01) |
| *F21Y 101/00* | (2016.01) |

(52) U.S. Cl.
CPC ..... *F21V 21/15* (2013.01); *F21S 8/04* (2013.01); *F21V 23/00* (2013.01); *G09F 23/00* (2013.01); *G09F 27/00* (2013.01); *H05B 37/0272* (2013.01); *F21W 2121/006* (2013.01); *F21Y 2101/00* (2013.01); *F21Y 2115/10* (2016.08); *G09F 9/33* (2013.01)

(58) Field of Classification Search
CPC .. F21V 21/15; F21V 23/00; F21S 8/04; G09F 27/00; G09F 23/00; G09F 9/33; H05B 37/0272; F21Y 2115/10; F21Y 2101/00; F21W 2121/006
See application file for complete search history.

(56) References Cited

U.S. PATENT DOCUMENTS

| | | | | |
|---|---|---|---|---|
| 4,009,745 | A | 3/1977 | Erpenbeck | |
| 5,136,489 | A * | 8/1992 | Cheng | F21S 8/04 362/285 |
| 6,474,840 | B2 | 11/2002 | Padermos | |
| 6,918,680 | B2 | 7/2005 | Seeberger | |
| 6,971,768 | B1 * | 12/2005 | Pepito | F21S 4/10 362/238 |
| 6,984,944 | B2 | 1/2006 | Garrity | |
| 7,825,790 | B2 | 11/2010 | Tallinger | |
| 7,878,684 | B2 | 2/2011 | Nauman | |
| 8,136,962 | B2 | 3/2012 | Marlonia | |
| 8,297,804 | B2 * | 10/2012 | Buse | F21V 21/04 362/147 |
| 9,548,008 | B1 * | 1/2017 | Manning | G09F 9/302 |
| 9,630,769 | B2 | 4/2017 | Schultz | |
| 9,777,895 | B2 | 10/2017 | Bokun | |
| 2008/0285294 | A1 | 11/2008 | Kim | |
| 2009/0201681 | A1 * | 8/2009 | Galke | F21S 2/00 362/249.07 |
| 2010/0110668 | A1 | 5/2010 | Marlonia | |

(Continued)

*Primary Examiner* — Karabi Guharay
*Assistant Examiner* — Glenn D Zimmerman
(74) *Attorney, Agent, or Firm* — Brian S. Steinberger; Hilary F. Steinberger; Law Offices of Brian S. Steinberger, P.A.

(57) ABSTRACT

Self-contained devices, systems and methods for housing holiday lights in the form of icicles, and the like, in self-contained boxes that can easily be mounted and removed around house windows and eaves. The lights can be retractable and extendable from the boxes, and the lights can be remotely controlled by smart phones and the like. The boxes can have displays for holiday messages as well as speakers for playing music and messages.

18 Claims, 19 Drawing Sheets

(56) References Cited

U.S. PATENT DOCUMENTS

| | | | | |
|---|---|---|---|---|
| 2011/0164409 | A1 | 7/2011 | Smith et al. | |
| 2013/0039067 | A1 | 2/2013 | Wong | |
| 2014/0091719 | A1 | 4/2014 | Tsai | |
| 2015/0102731 | A1 | 4/2015 | Altamura et al. | |
| 2016/0131348 | A1* | 5/2016 | Rima | F21V 21/15 362/145 |
| 2016/0215971 | A1 | 7/2016 | Silver et al. | |

* cited by examiner

RETRACTABLE HOLIDAY LIGHTS

FIELD OF INVENTION

This invention relates to holiday lights, and in particular to self-contained devices, systems and methods for housing holiday lights in the form of icicles, and the like, in self-contained boxes that can easily be mounted and removed around house windows and eaves, where the lights are retractable and extendable from the boxes, and the lights can be remotely controlled by smart phones and the like, the boxes can have displays for holiday messages as well as speakers for playing music and messages.

BACKGROUND AND PRIOR ART

Outdoor holiday lights, such as those used during Christmas, are often hung from around December and are taken down after the winter holiday season. The most popular of these lights are strung around exterior walls and on roofs of houses and come with many problems.

For example, hanging exterior light strings usually requires time and labor to install and take down the lights, while balancing on a ladder, and attaching the light strings by fasteners, such as nails and screws, to exterior surfaces of the houses and roofs. In addition to the danger of falling off a ladder, the fasteners, such as nails and screws can cause direct damage to exterior walls and in roofs that can require repairs and more work over time.

In addition, the light strings are difficult to store when not being used, and often become tangled and damaged and not useable down the road. To be reused, the light strings have to be rehung and again taken down repeating the same problems described above.

Thus, the need exists for solutions to the above problems with the prior art.

SUMMARY OF THE INVENTION

A primary objective of the present invention is to provide self-contained devices, systems and methods for housing holiday lights in the form of icicles, and the like, in self-contained boxes that can easily be mounted and removed around house windows and eaves, where the lights are retractable and extendable from the boxes.

A secondary objective of the present invention is to provide retractable and extendable holiday lights in self-contained boxes, where the lights can be remotely controlled by smart phones and the like.

A third objective of the present invention is to provide retractable and extendable holiday lights in self-contained boxes, having displays for holiday messages and speakers for playing music and messages.

A retractable lighting system can include a rectangular box having a top panel, front panel, left panel, right panel, back panel and bottom panel, along with guide members on at least one inside walls of the box, along with a moveable frame being raiseable and lowerable along the guide members, along with a plurality of spaced apart lights attached to and extending below the moveable frame, wherein the moveable frame with the plurality of the lights is moveable from a stored position with both the frame and the plurality of the lights inside the box to an extended position with the plurality of lights extending below the box by sliding the moveable frame along the guide members.

The moveable frame can include a panel with a notched end for the guide members.

The bottom panel can include a hinge for dropping the bottom panel downward away from the front panel when the plurality of the lights is being lowered to the extended position.

The plurality of the lights can include a row of downwardly extending rigid lights, such as icicle shaped lights.

Each of the icicle shaped lights can include light emitting diodes (LEDs).

The retractable lighting system can further include a motor inside of the box, a cable spool mounted inside of the box, a cable having an inner end wound about the spool and at least one outer end attached to the moveable frame, and a motor mounted inside the box for rotating the spool to wind the cable about the spool or unwind the at least one outer end of the cable from the spool in order to lower and raise the moveable frame.

The retractable lighting system can further include at least one rail pulley mounted inside the box above the moveable frame.

The retractable lighting system can further include a motor inside of the box, a cable spool mounted inside of the box, a cable having an inner end wound about the spool and at least one outer end attached to both the moveable frame and the hinged bottom panel, wherein the motor is for rotating the spool to wind the cable about the spool or unwind the at least one outer end of the cable from the spool in order to lower and raise the moveable frame.

The front panel can include a display for showing text messages. The front panel can include at least one speaker.

The retractable lighting system can include a remote controller for remotely turning on and off the plurality of lights, and/or the message display, and/or the speaker. The remote controller can be a smart phone.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

Figure 1:
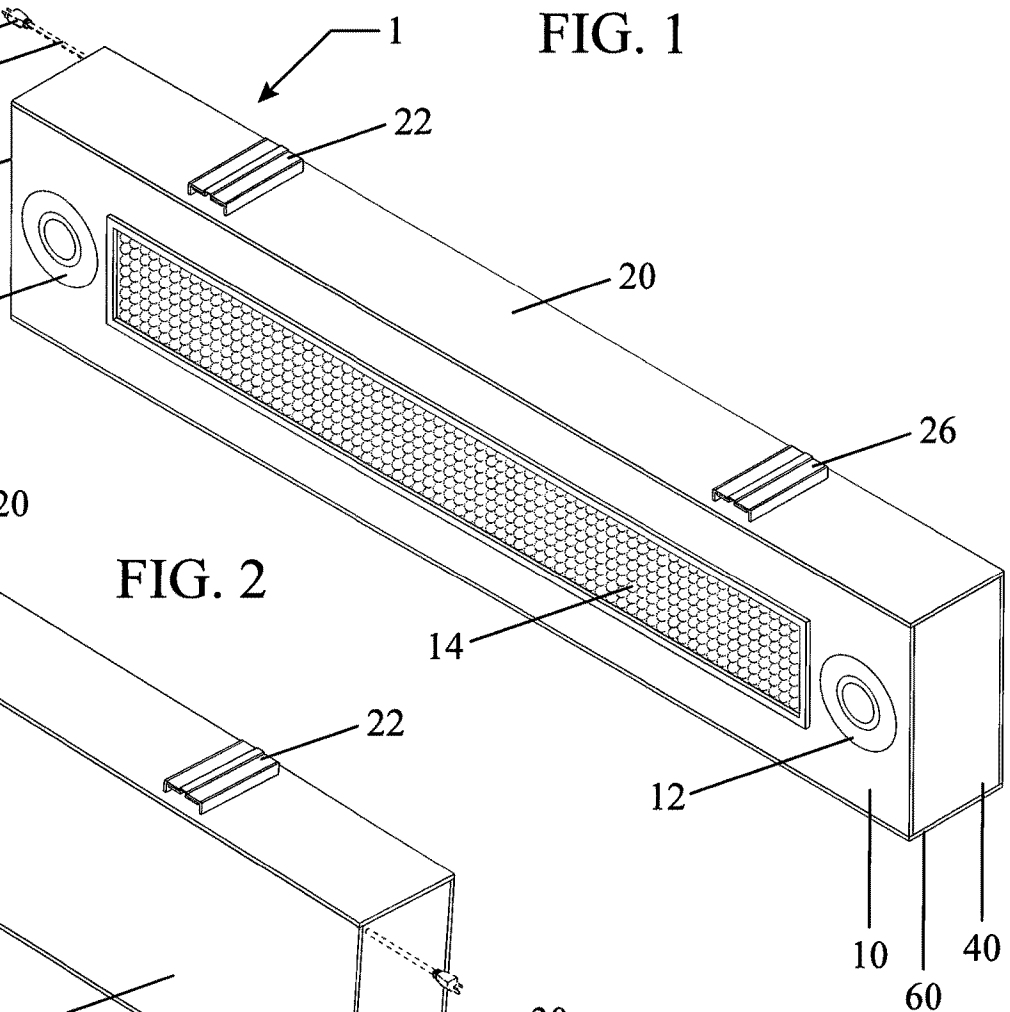
FIG. 1 is an upper front perspective view of the novel retractable holiday lights housing, with lights retracted inside the housing.
Figure 2:
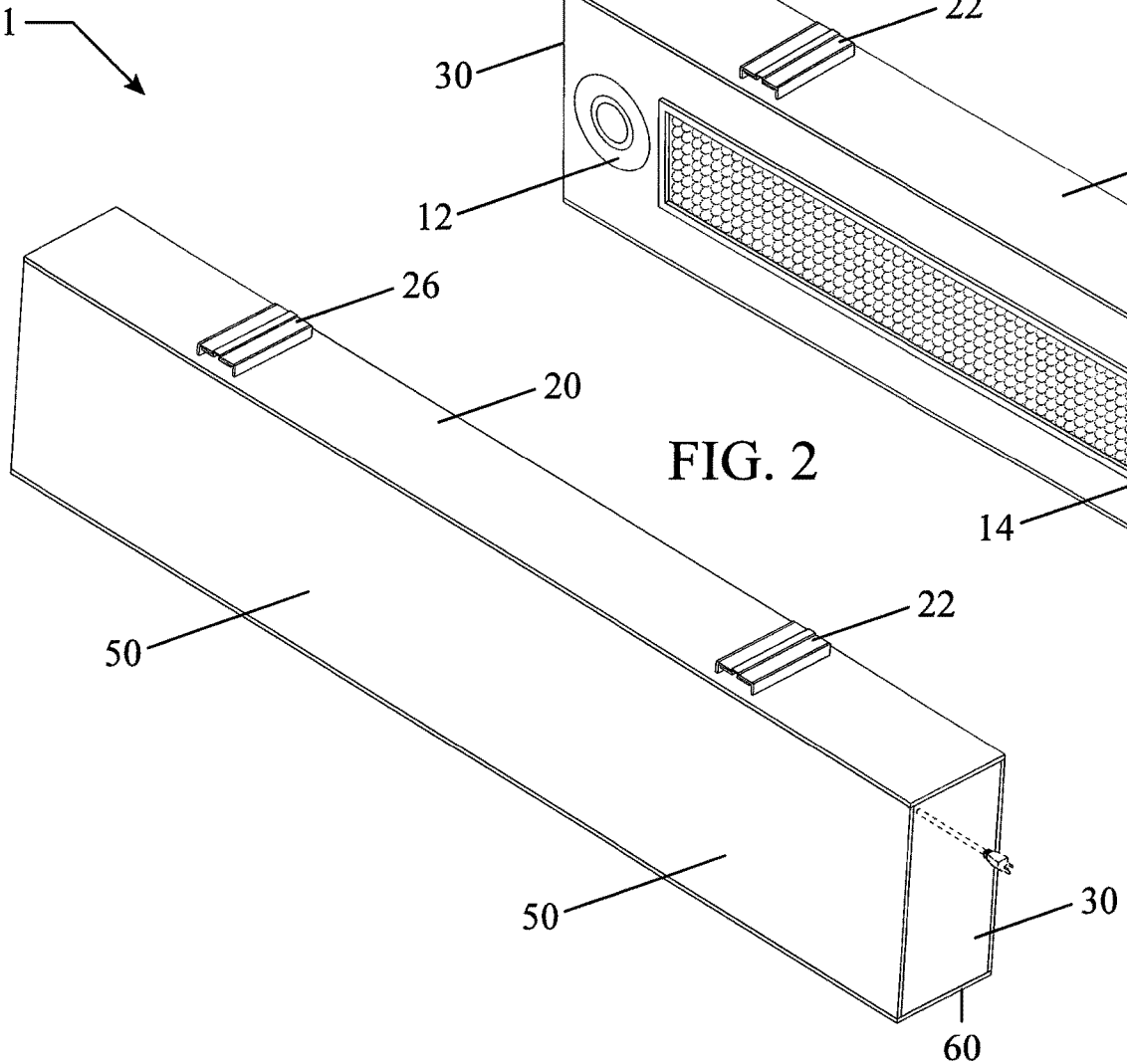
FIG. 2 is an upper rear perspective view of the retractable holiday lights housing of FIG. 1.
Figure 3:
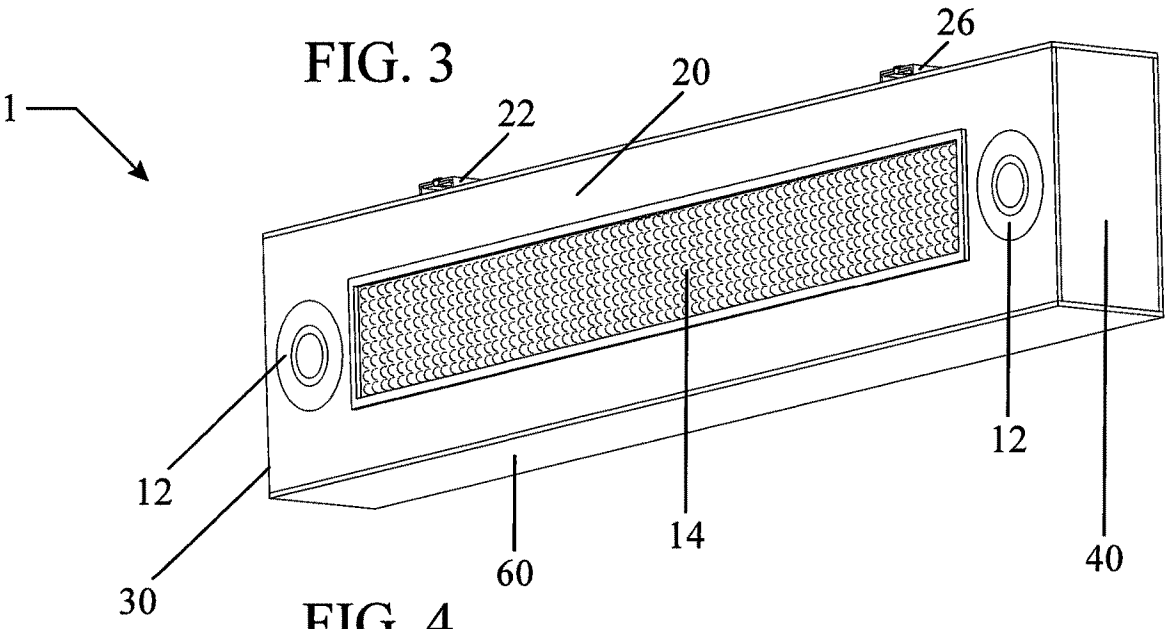
FIG. 3 is a lower front perspective view of the retractable holiday lights housing of FIG. 1.
Figure 4:
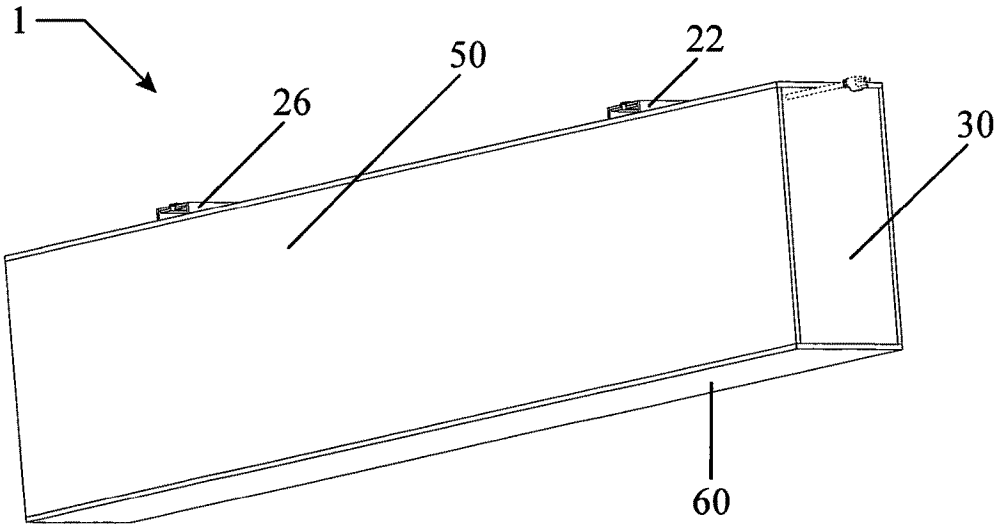
FIG. 4 is a lower rear perspective view of the retractable holiday lights housing of FIG. 1.
Figure 5:
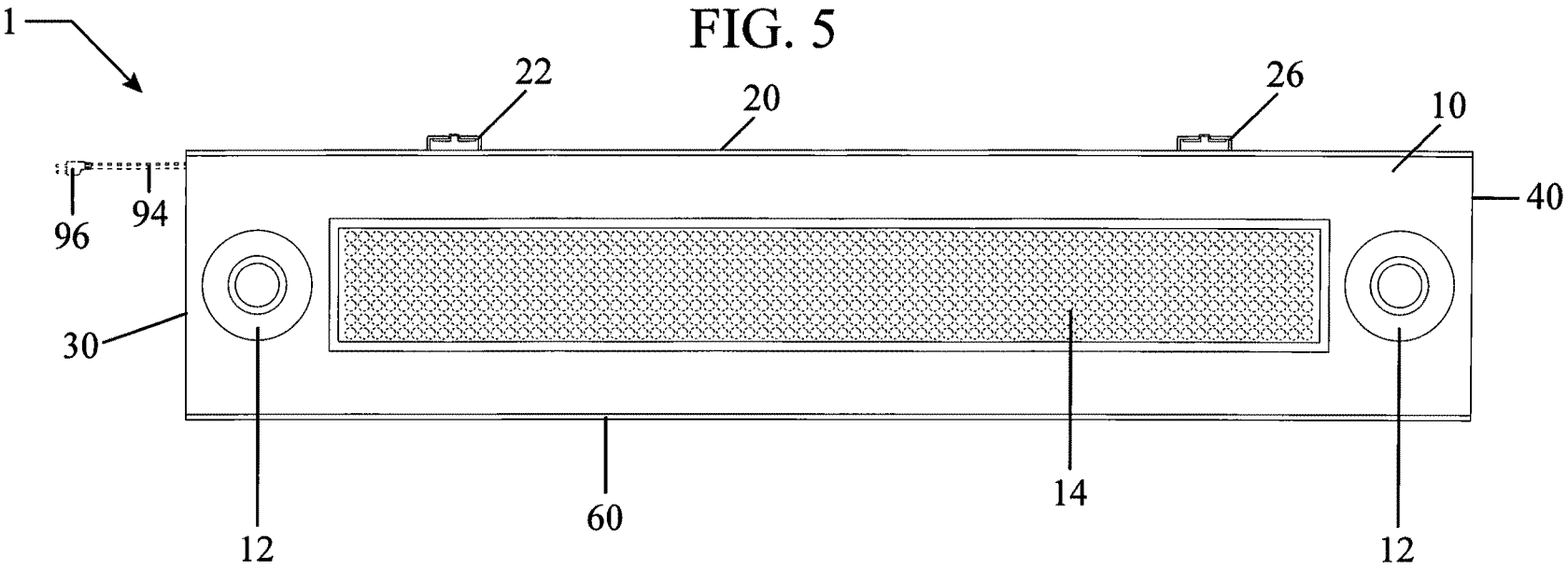
FIG. 5 is a front view of the retractable holiday lights housing of FIG. 1.
Figure 6:
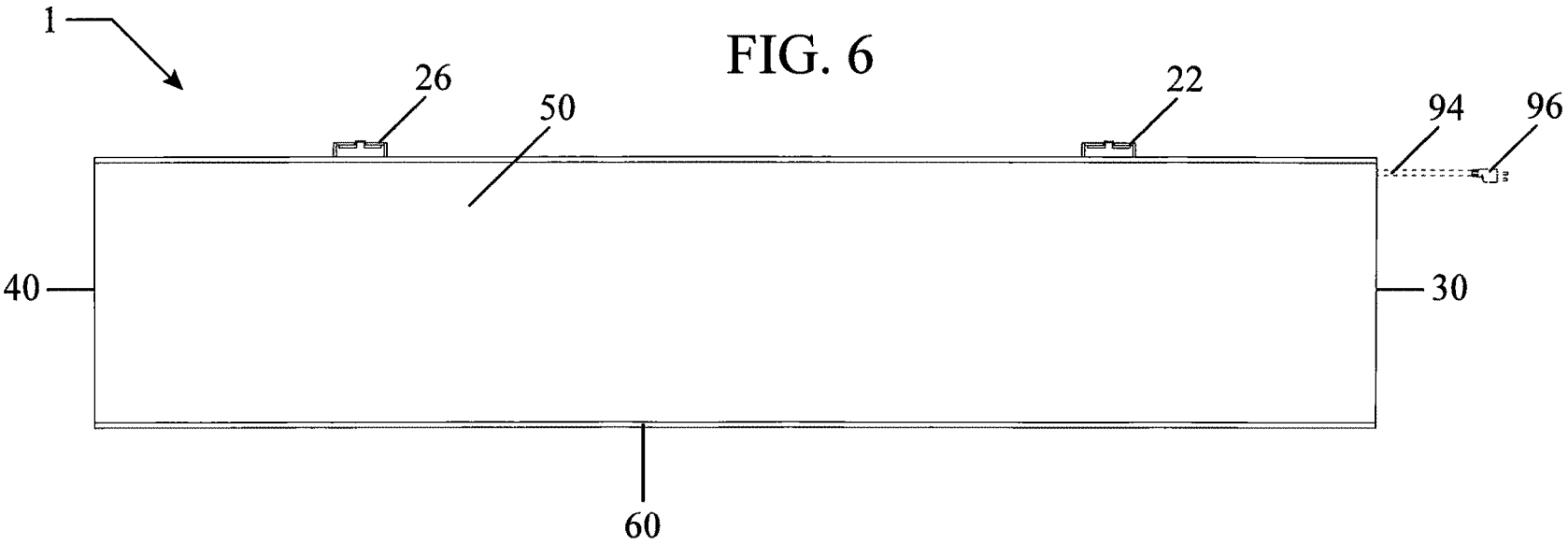
FIG. 6 is a rear view of the retractable holiday lights housing of FIG. 1.
Figure 7:
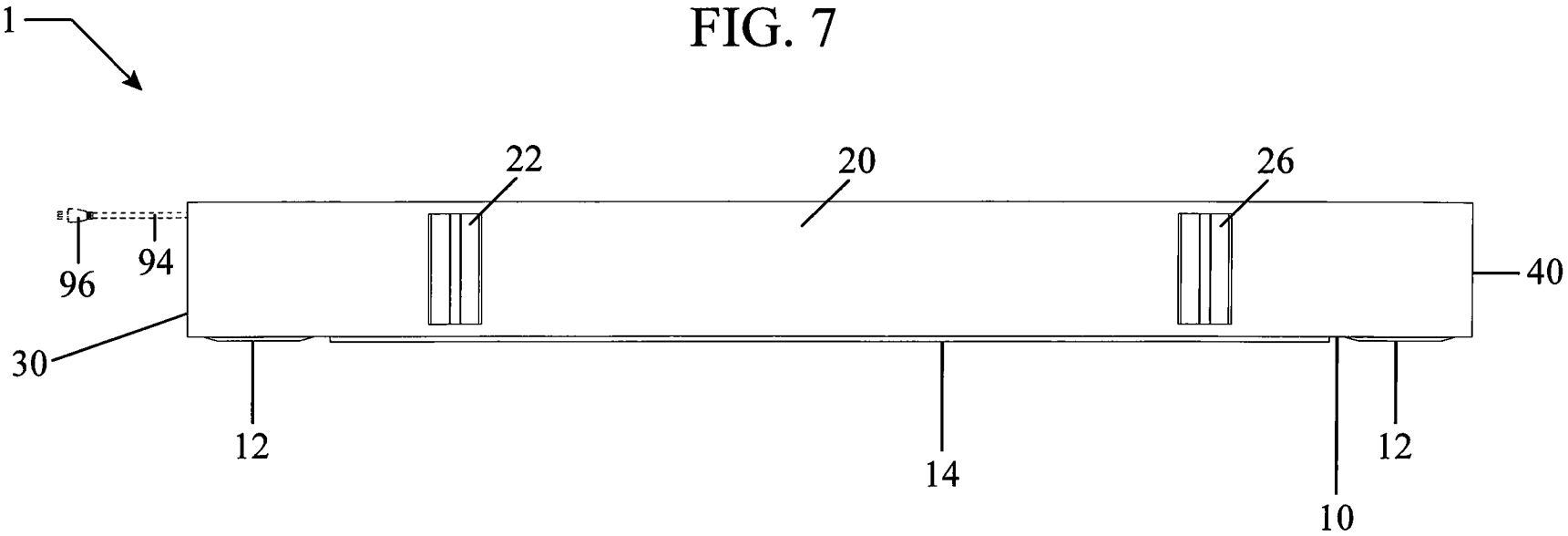
FIG. 7 is a top view of the retractable holiday lights housing of FIG. 1.
Figure 8:
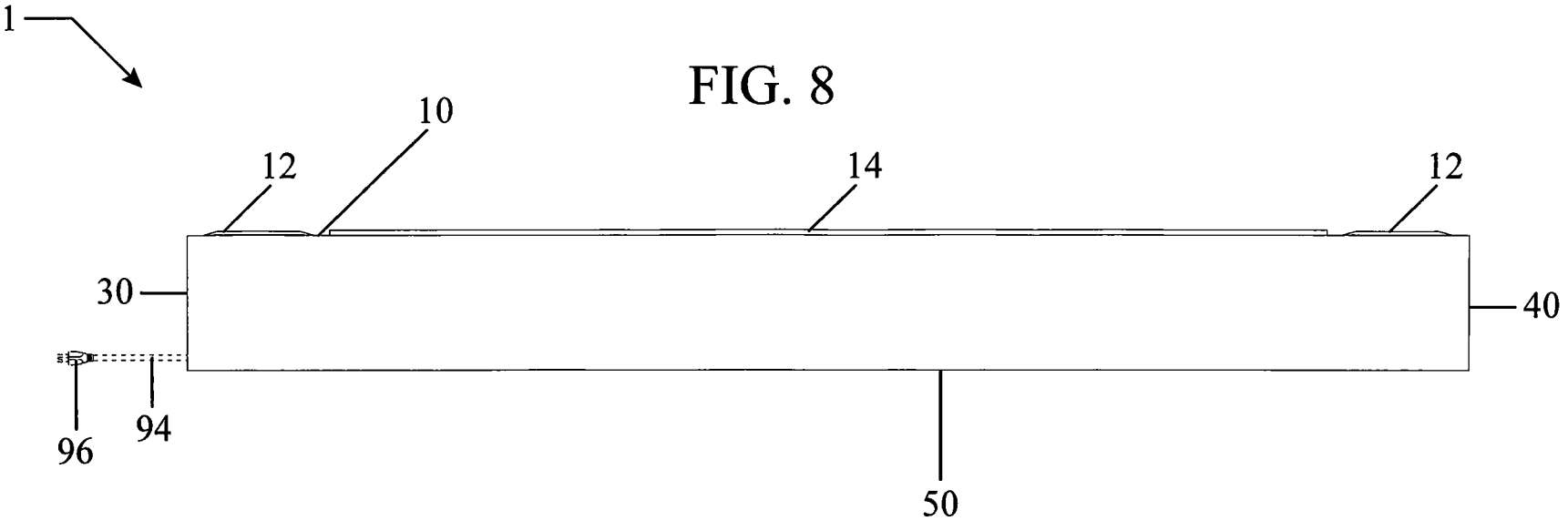
FIG. 8 is a bottom view of the retractable holiday lights housing of FIG. 1.
Figure 10:
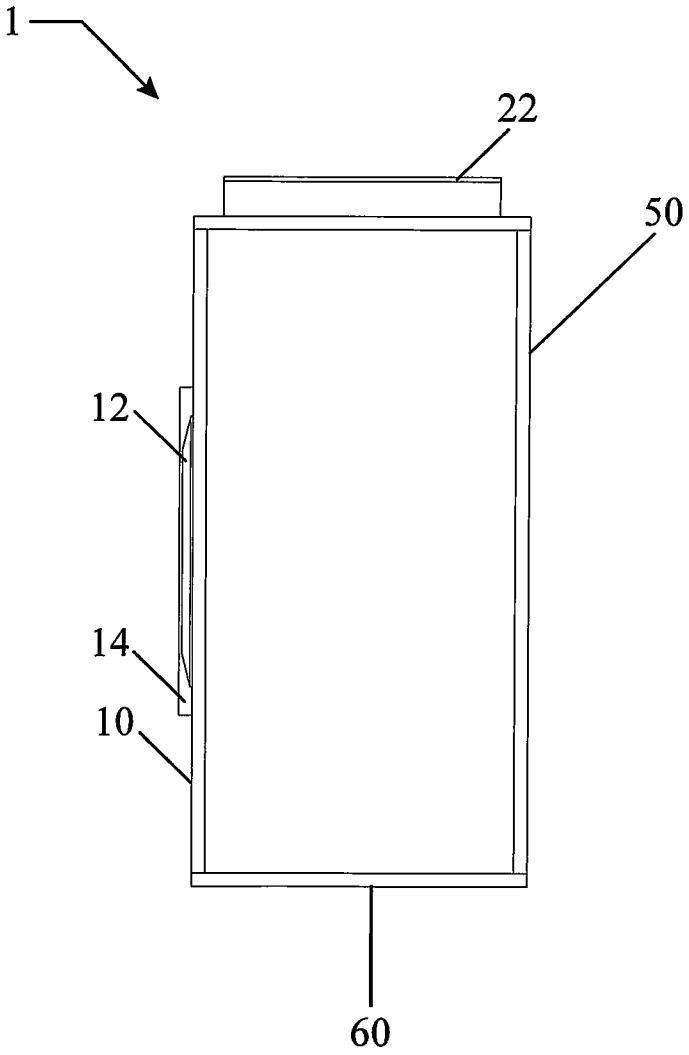
FIG. 10 is a right side view of the retractable holiday lights housing of FIG. 1.
Figure 9:
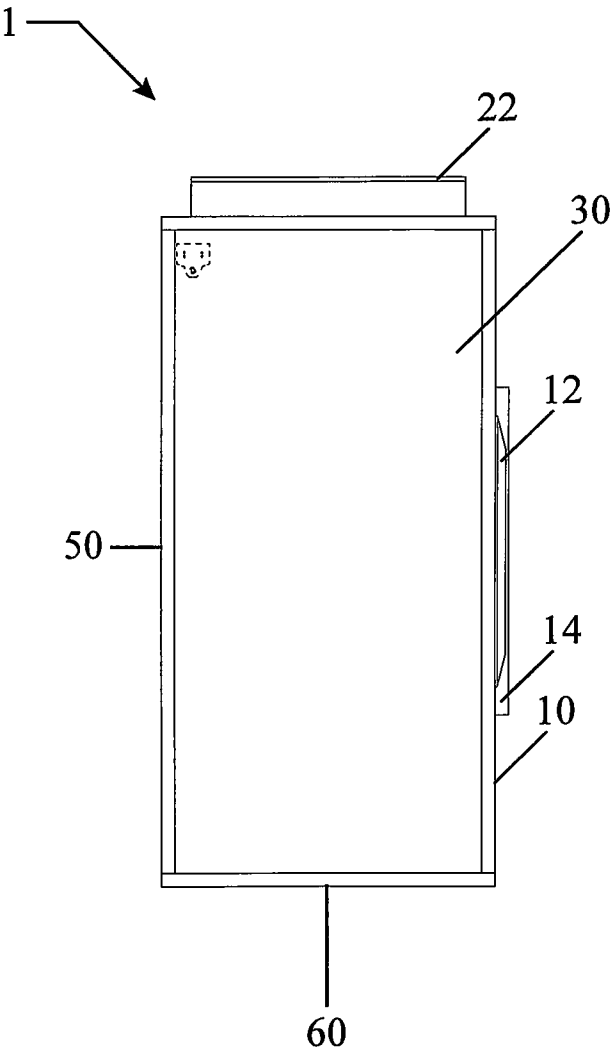
FIG. 9 is a left side view of the retractable holiday lights housing of FIG. 1.

1 retractable lights housing/box
10 front face panel
12 speakers
14 display
20 top panel
22 left top mount bracket
24 base mount bracket
26 right top mount bracket
30 left side panel
40 right side panel
50 rear panel
60 bottom panel/door
65 hinge
70 top platform
73 notched sides of top platform
74 lower platform with circuit board electronics
80 guide rails/tracks
81, 83 cables
82 left guide pulley
84 cable spool
88 right guide pulley
90 motor in motor housing
92 WI-FI and Electronics
94 power cord
95 spring/retractable power cord
96 plug
98 power supply/battery pack
100 icicle shaped light(s)
110 LEDs (light emitting diodes)
150 smart phone
160 master control unit
200 house application
210 eaves
220 windows
230 overhang FIG. 1 is an upper front perspective view of the novel retractable holiday lights housing 1, with lights (not shown) retracted inside the housing 1. FIG. 2 is an upper rear perspective view of the retractable holiday lights housing 1 of FIG. 1. FIG. 3 is a lower front perspective view of the retractable holiday lights housing 1 of FIG. 1. FIG. 4 is a lower rear perspective view of the retractable holiday lights housing 1 of FIG. 1. FIG. 5 is a front view of the retractable holiday lights housing 1 of FIG. 1. FIG. 6 is a rear view of the retractable holiday lights housing 1 of FIG. 1. FIG. 7 is a top view of the retractable holiday lights housing 1 of FIG. 1. FIG. 8 is a bottom view of the retractable holiday lights housing 1 of FIG. 1. FIG. 9 is a left side view of the retractable holiday lights housing 1 of FIG. 1. FIG. 10 is a right side view of the retractable holiday lights housing 1 of FIG. 1.

Referring to FIGS. 1-10, the retractable lights housing 1 can include a front face panel 10 with one or more speakers 12 that can be located on opposite sides of a display screen 14. The display screen 14 can be a display of LEDs (light emitting diodes), neon lights, and the like. Alternatively, the display screen 14 can be a colored lens, and the like.

The retractable lights housing 1 can further include a top panel 20 having left top mount bracket 22 and right top mount bracket 26, a left side panel 30, a right side panel 40, a rear panel 50 and a hinged bottom panel/door 60.

Referring to FIGS. 1-10, the retractable lights housing 1 can have a generally rectangular box shape that can be made from aluminum, galvanized metal, plastic, and the like.

The box 1 can have a longitudinal length of approximately 2 feet to approximately 5 feet or more, and have a height of approximately 1 to approximately 2 feet, and a width of approximately 1 to approximately 1.5 feet. The box 1 can be sized to fit under an eave above a window opening, and the like. Additionally, the box 1 can have dimensions that have a width of a typical window width and a depth of less than the depth of an existing eave above a window, and a height that can fit in the space above a window.

The lights 100 can hang down up to approximately 10 inches or more, and be spaced apart from one another between approximately 2 to approximately 3 inches, less or more.

Figures 11, 12:
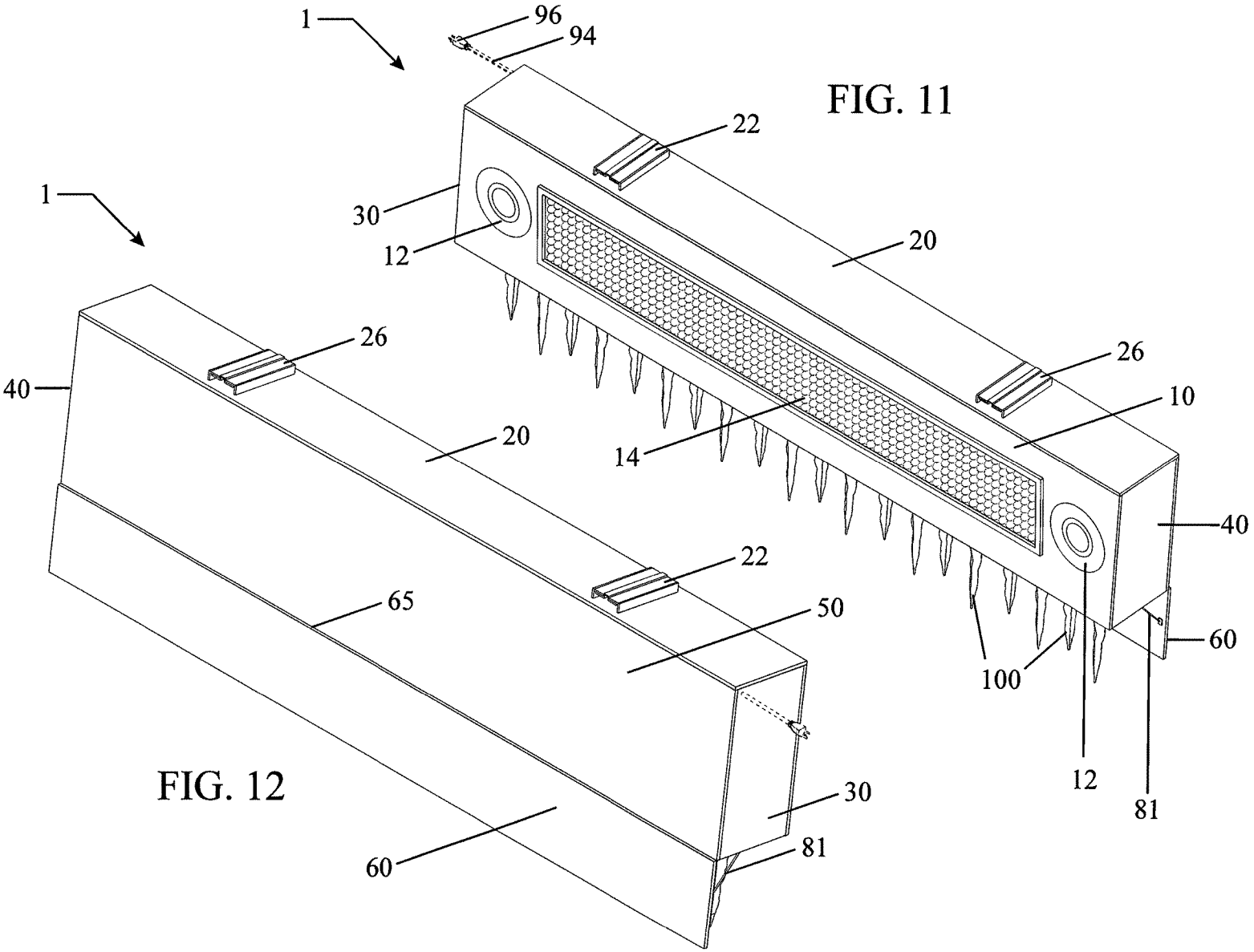
FIG. 11 is an upper front perspective view of the novel retractable holiday lights housing, with lights extended below the housing.
FIG. 12 is an upper rear perspective view of the retractable holiday lights housing of FIG. 11.
Figure 13:
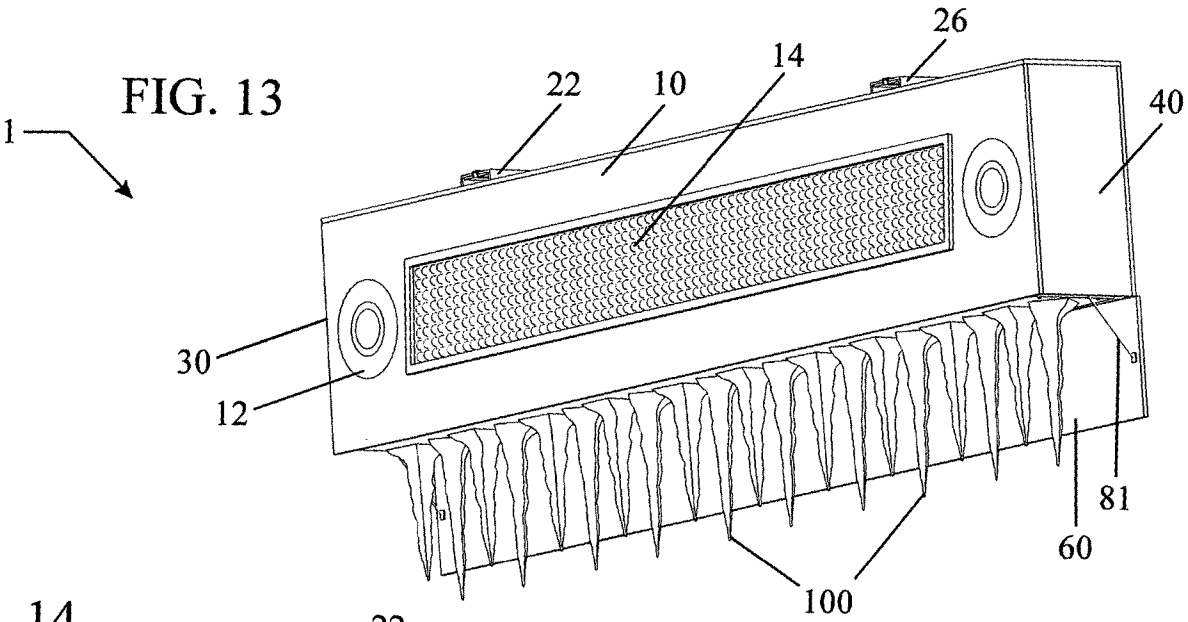
FIG. 13 is a lower front perspective view of the retractable holiday lights housing of FIG. 11.
Figure 14:
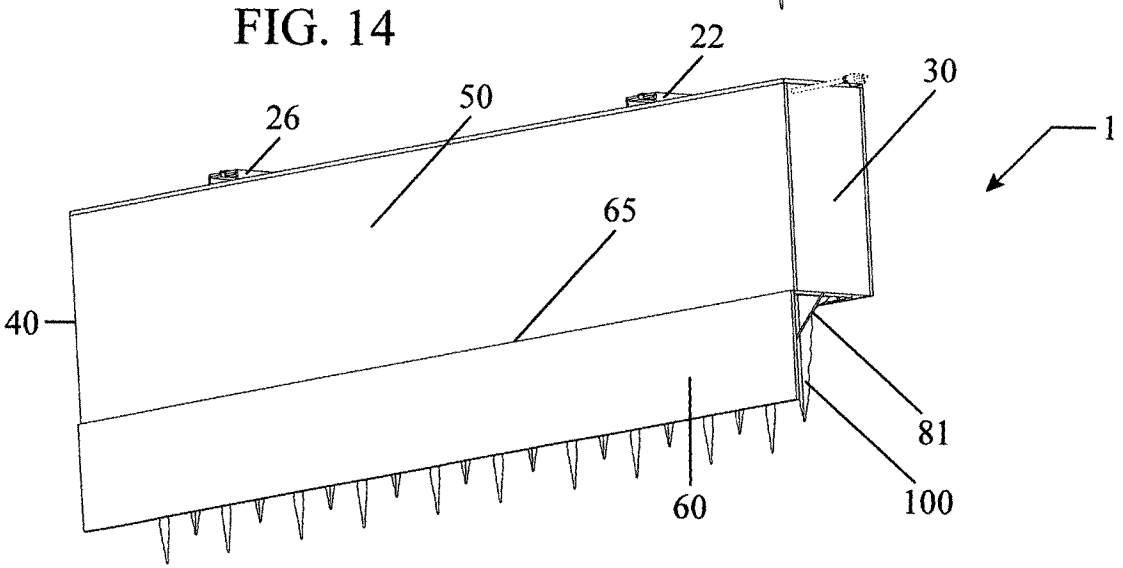
FIG. 14 is a lower rear perspective view of the retractable holiday lights housing of FIG. 11.
Figure 15:
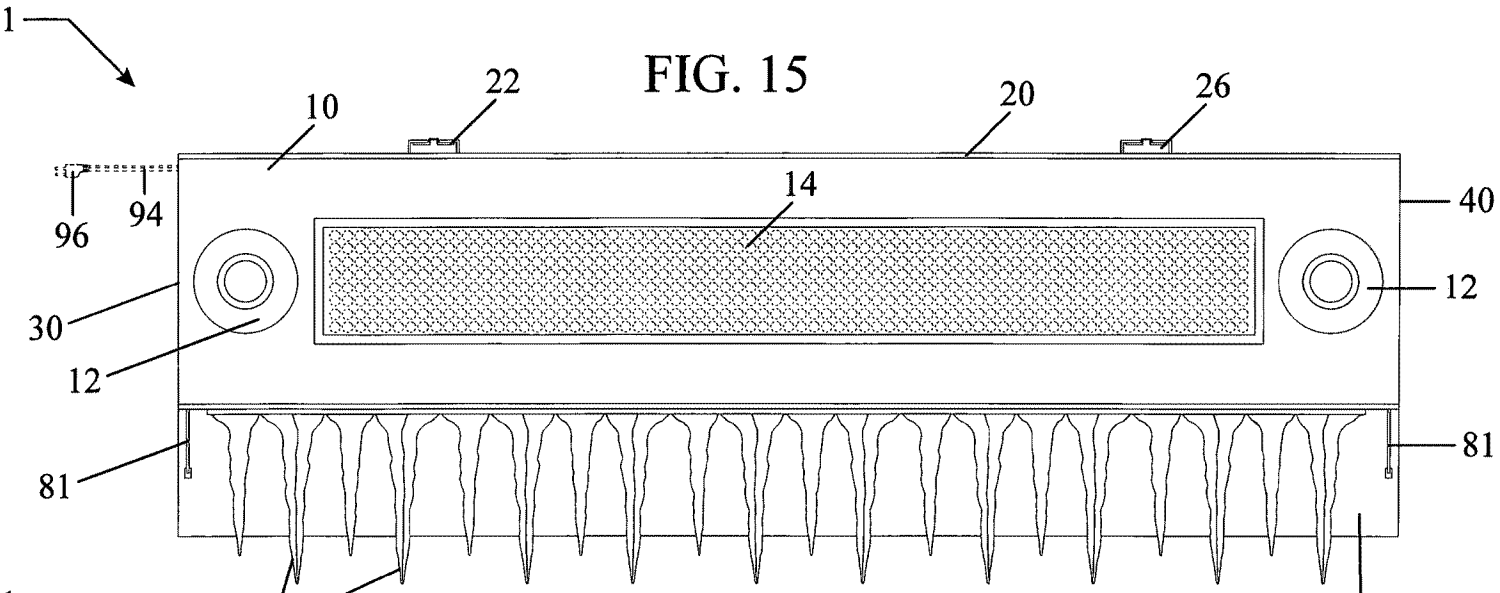
FIG. 15 is a front view of the retractable holiday lights housing of FIG. 11.
Figure 16:
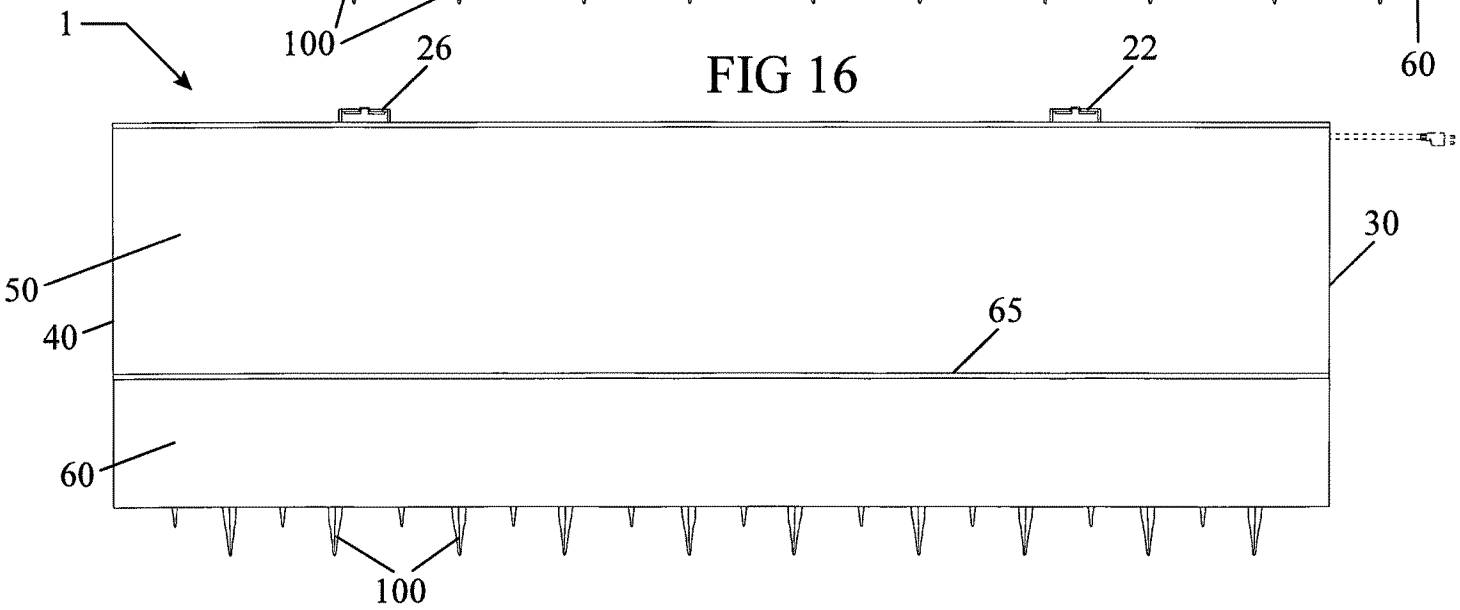
FIG. 16 is a rear view of the retractable holiday lights housing of FIG. 11.
Figure 17:
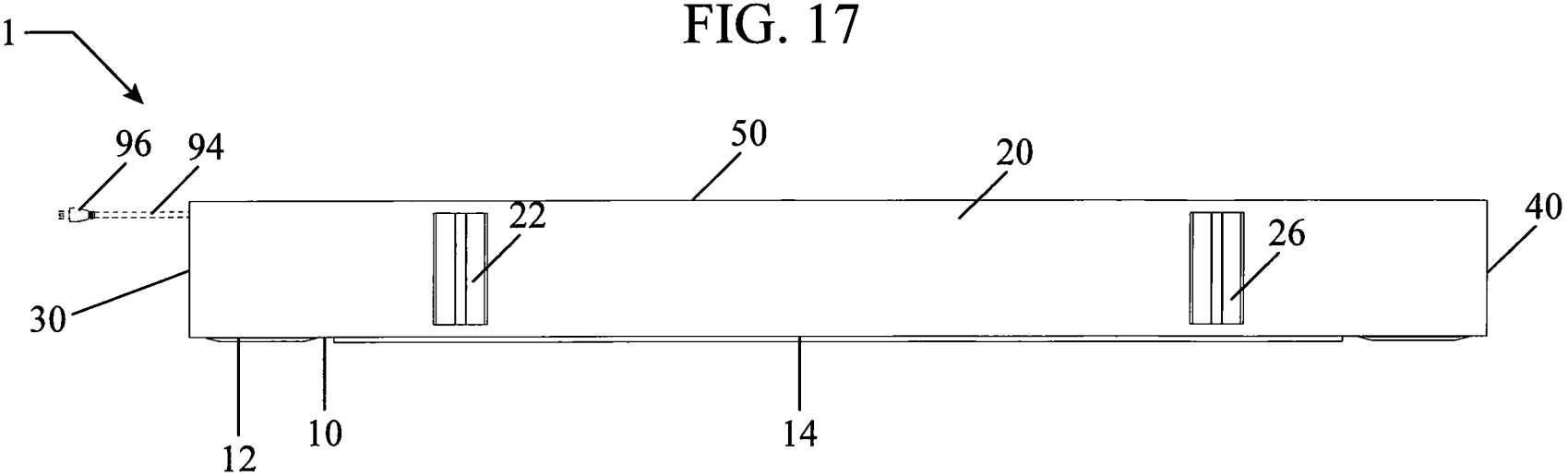
FIG. 17 is a top view of the retractable holiday lights housing of FIG. 11.
Figure 18:
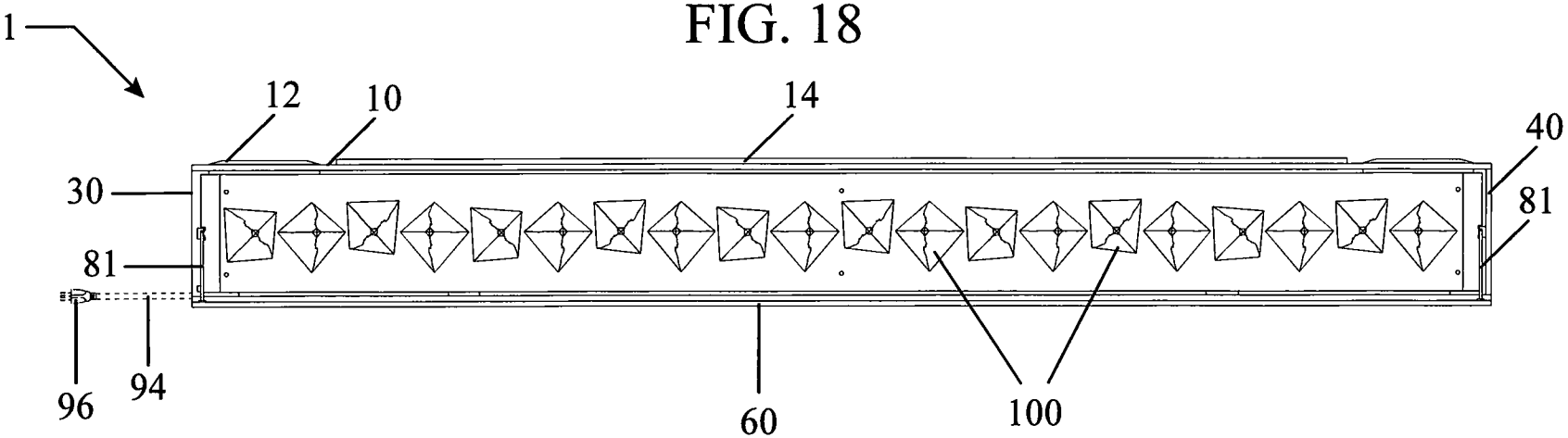
FIG. 18 is a bottom view of the retractable holiday lights housing of FIG. 11.
Figure 20:
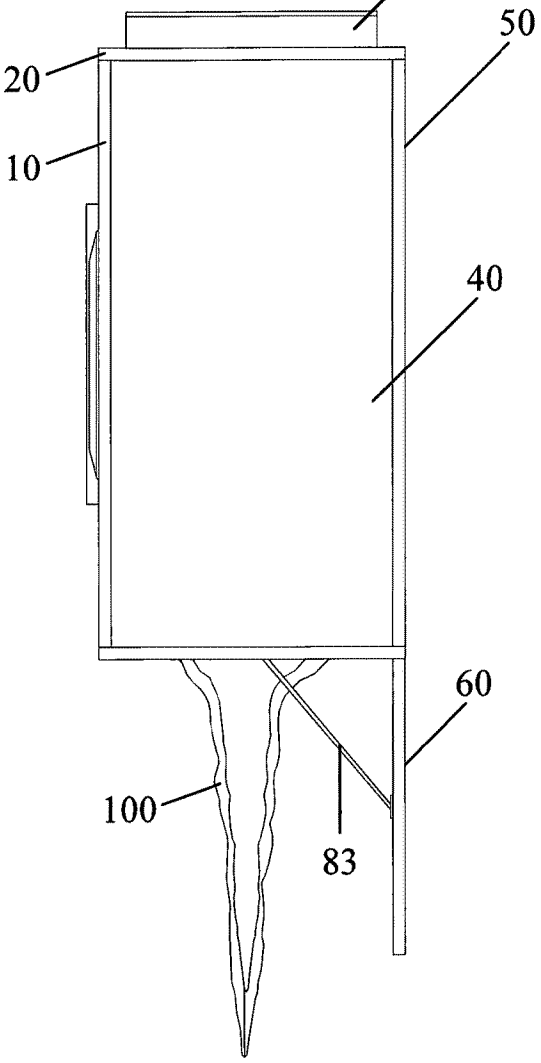
FIG. 20 is a right side view of the retractable holiday lights housing of FIG. 11.
Figure 19:
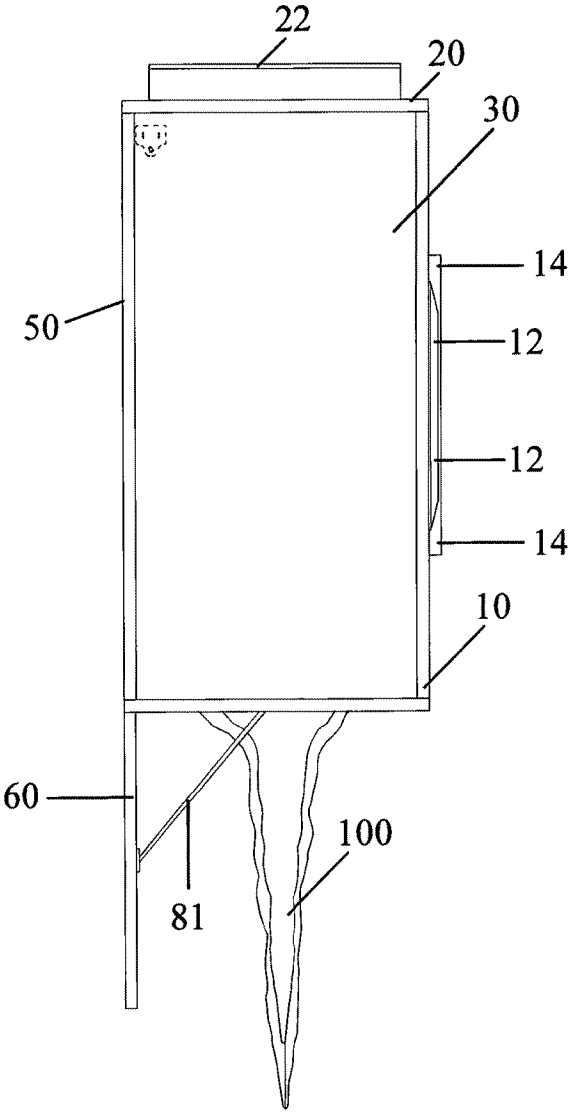
FIG. 19 is a left side view of the retractable holiday lights housing of FIG. 11.

FIG. 11 is an upper front perspective view of the novel retractable holiday lights housing 1, with lights 100 extended below the housing 1. FIG. 12 is an upper rear perspective view of the retractable holiday lights housing 1 of FIG. 11. FIG. 13 is a lower front perspective view of the retractable holiday lights housing 1 of FIG. 11. FIG. 14 is a lower rear perspective view of the retractable holiday lights housing 1 of FIG. 11. FIG. 15 is a front view of the retractable holiday lights housing 1 of FIG. 11. FIG. 16 is a rear view of the retractable holiday lights housing 1 of FIG. 11. FIG. 17 is a top view of the retractable holiday lights housing 1 of FIG. 11. FIG. 18 is a bottom view of the retractable holiday lights housing 1 of FIG. 11. FIG. 19 is a left side view of the retractable holiday lights housing 1 of FIG. 11. FIG. 20 is a right side view of the retractable holiday lights housing 1 of FIG. 11.

Referring to FIGS. 11-20, in an extended position for the retractable housing 1 the bottom panel/door 60 opens on a hinge 65 based on the lowering of the icicles 100 from a cable 81 which will be shown and described in greater detail in the next figures.

Figure 21:
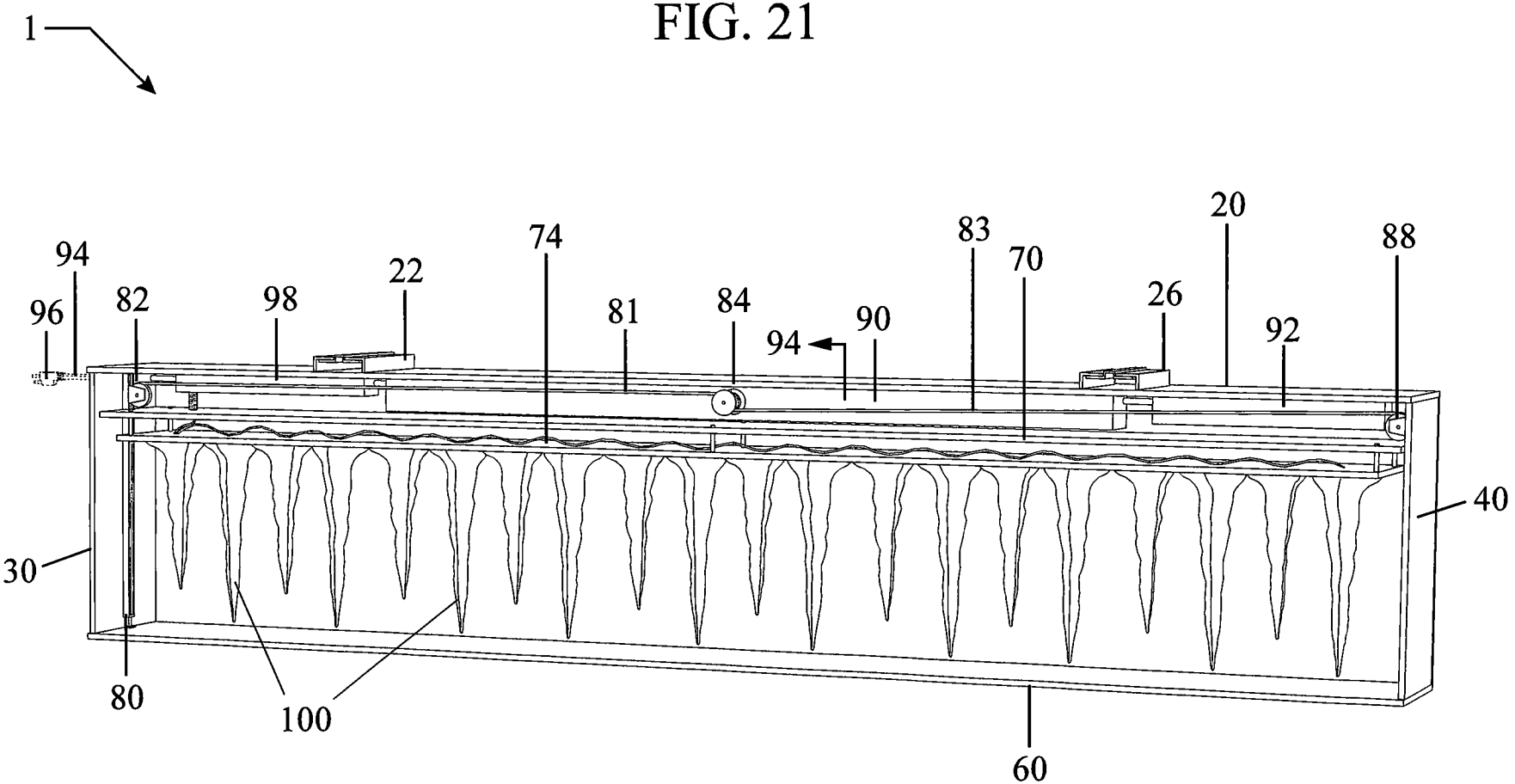
FIG. 21 is a front perspective view of the housing of FIG. 1 with the front face removed.
Figure 22:
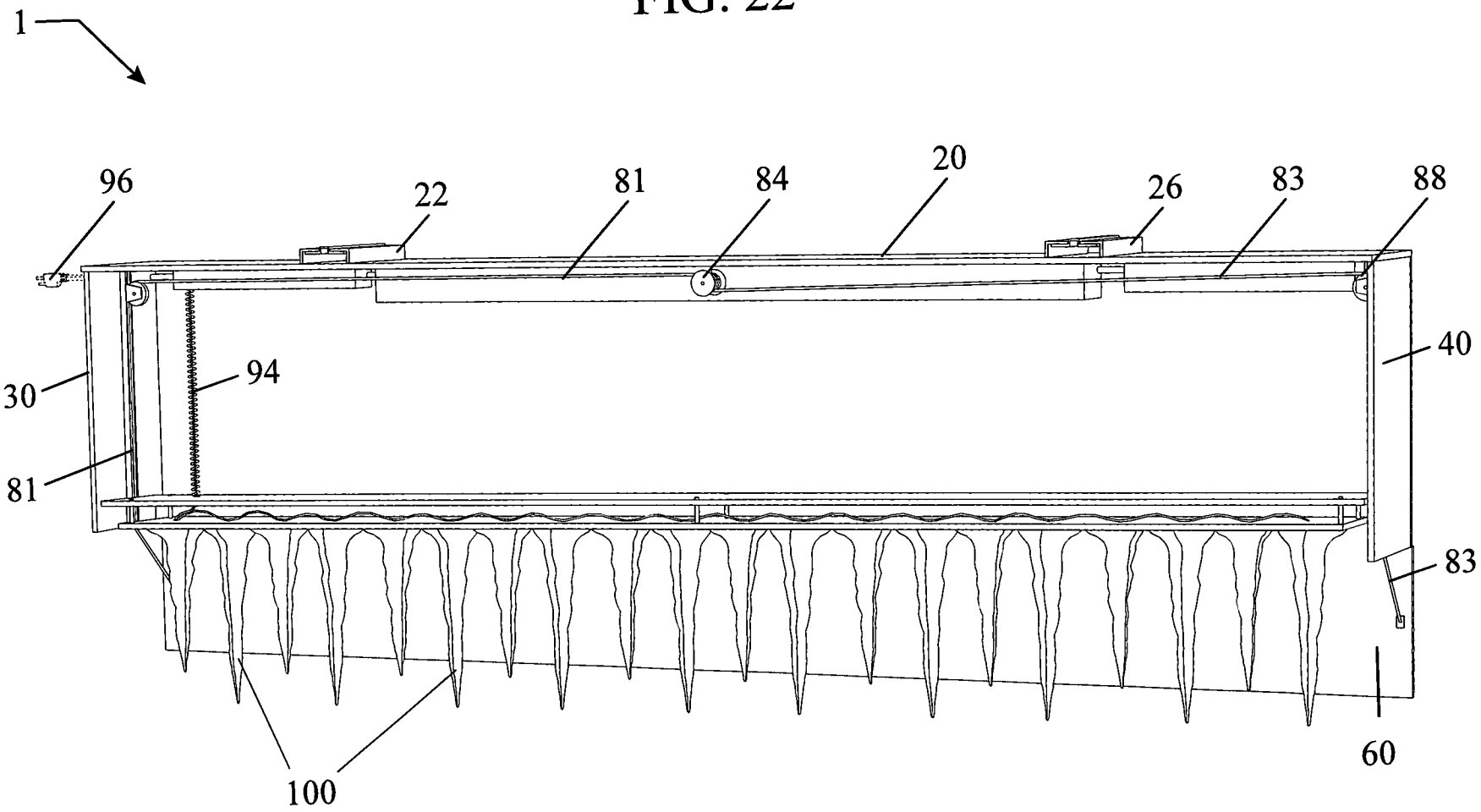
FIG. 22 is a front perspective view of the housing of FIG. 11 with the front face removed.
Figure 23:
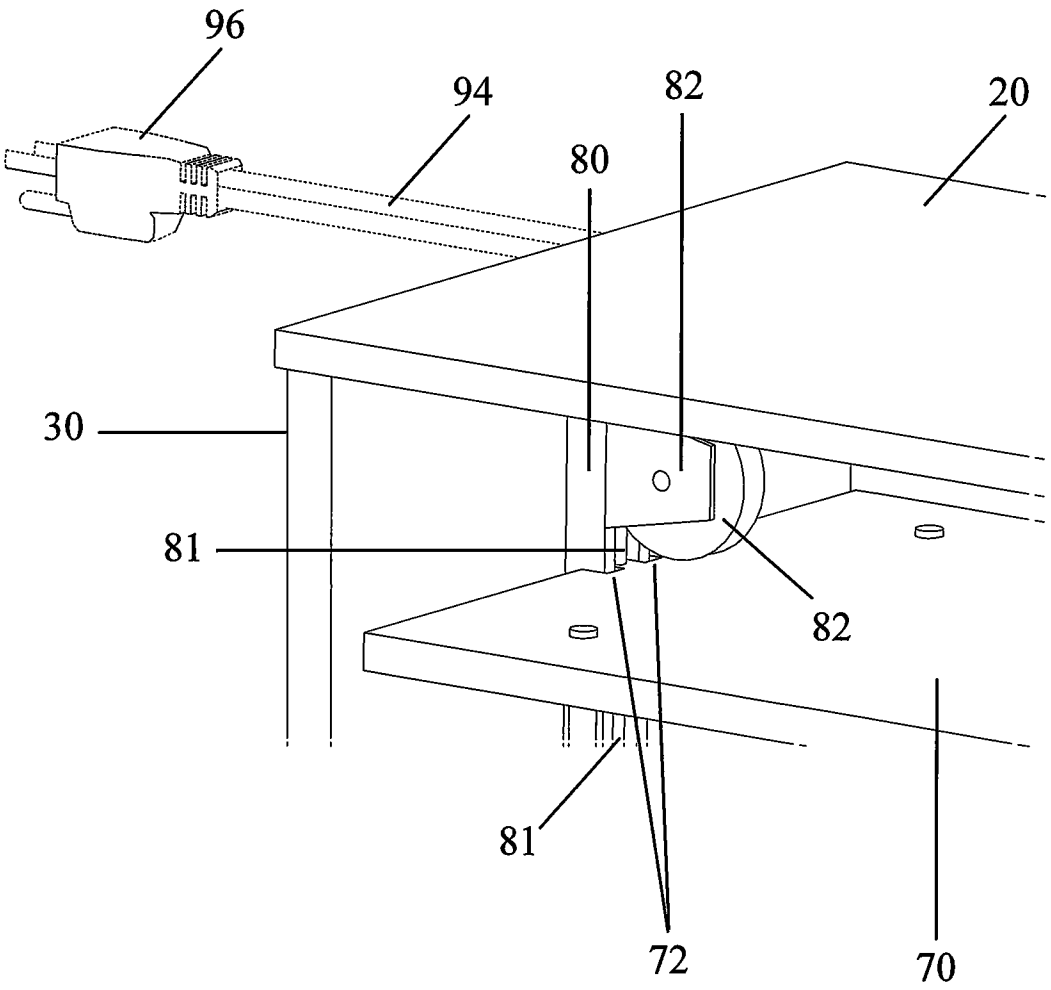
FIG. 23 is an enlarged perspective view of an inside portion within the housing of FIG. 1.
Figure 24C:
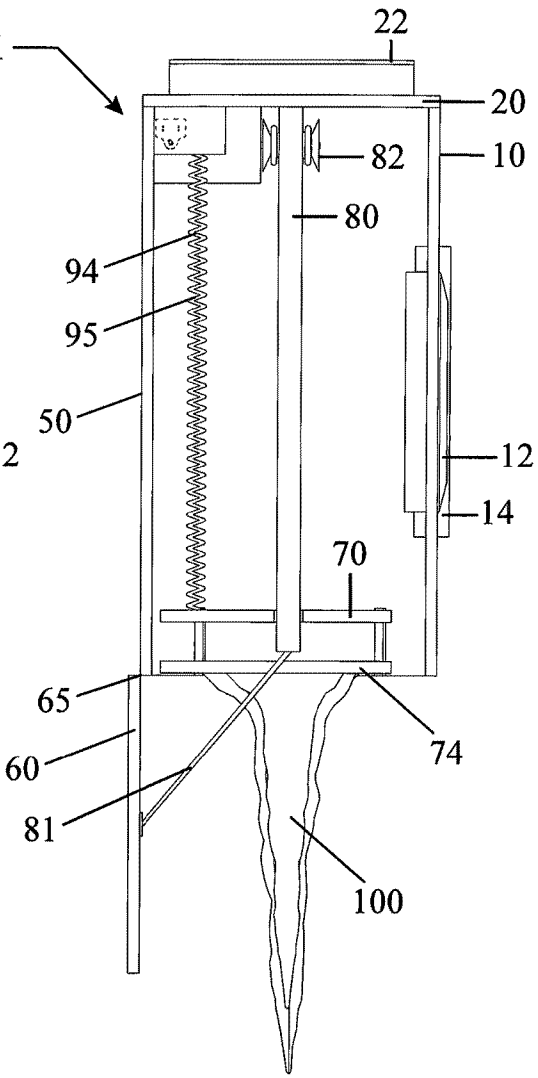
FIG. 24C is another side cross-sectional view of the housing of FIG. 24B with the lower door fully open and the lights fully extended below the housing.
Figure 24B:
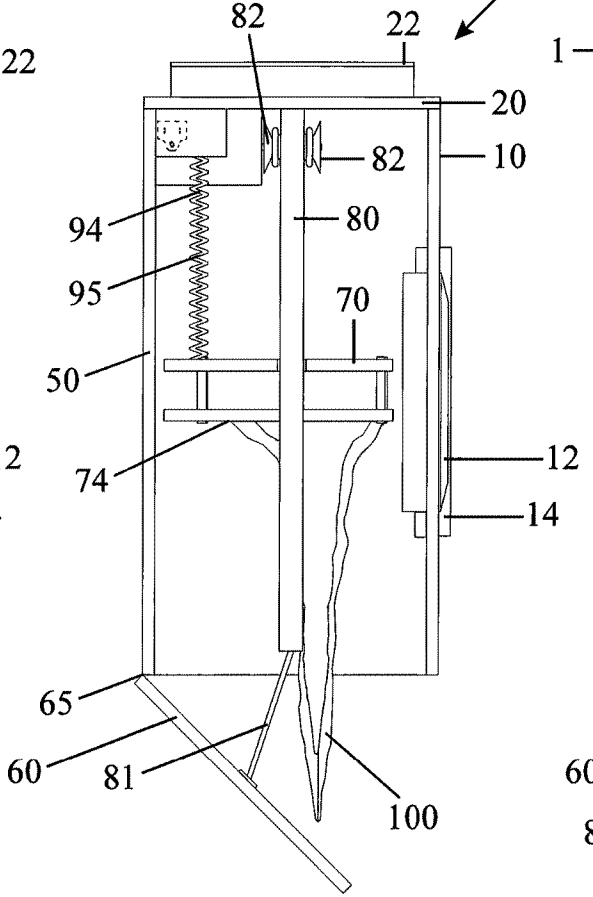
FIG. 24B is another side cross-sectional view of the housing of FIG. 24A with the lower door half open and the lights beginning to extend below the housing.
Figure 24A:
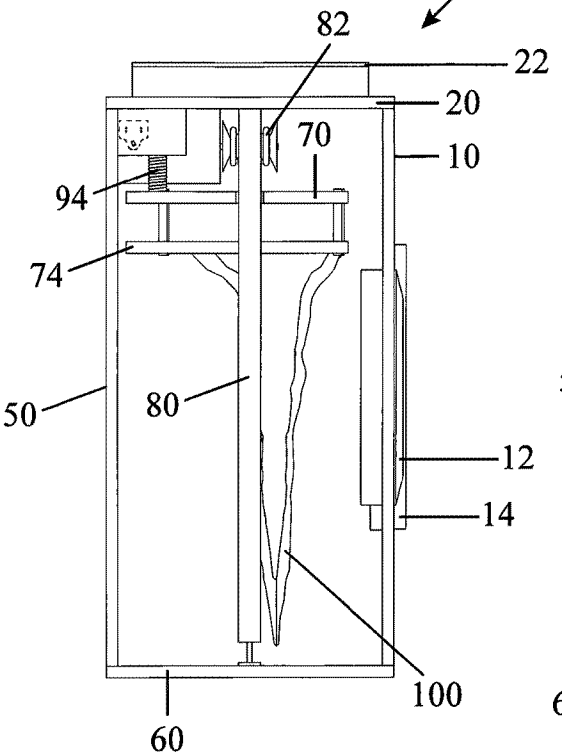
FIG. 24A is a side cross-sectional view of the housing of FIG. 1.

FIG. 21 is a front perspective view of the housing 1 of FIG. 1 with the front face panel 10 removed. FIG. 22 is a front perspective view of the housing 1 of FIG. 11 with the front face panel 10 removed. FIG. 23 is an enlarged perspective view of an inside portion within the housing 10 of FIG. 1. FIG. 24A is a side cross-sectional view of the housing 1 of FIG. 1 with the lights 100 in a retracted position inside the housing 1. FIG. 24B is another side cross-sectional view of the housing 1 of FIG. 24A with the lower door 60 half open on its' hinge 65 and the lights 100 beginning to extend below the housing 1. FIG. 24C is another side cross-sectional view of the housing 1 of FIG. 24B with the lower door 60 fully open and the lights 100 fully extended below the housing 1.

Referring to FIGS. 1-24C, an electric type motor powered by power cord 94 that can be plugged 96 in a household power supply, can rotate a cable spool 84 that can wind and unwind one or two cables 81, 83 thereon. The outer end(s) of the cables 81, 83 can be attached to both a side of top platform 70 followed by outer ends that can be attached to a bottom panel/door 60 that can be hinged 65 against the bottom edge of a rear panel 50. As the spool 84 unwinds, the cables 81, 83 can lower the platform 70 with the lights 100 downward, while opening bottom panel/door 60, until the lights 100 extend below box 1.

Reversing the rotation of spool 84 can pull up both cables 81, 83 and raise the platform 70 with downwardly extending lights 100 and close bottom panel/door 60. A left rail pulley 82 and right rail pulley 88 can orient outer the cables 81, 83 to fit about sides of the platform 70. The sides of the platform 70 can have notches 72 to allow the platform 70 to slide about the guide rails/tracks 80.

The wall plug 92 can also be used to charge a battery type power supply pack 98 to run motor 90.

Figure 25B:
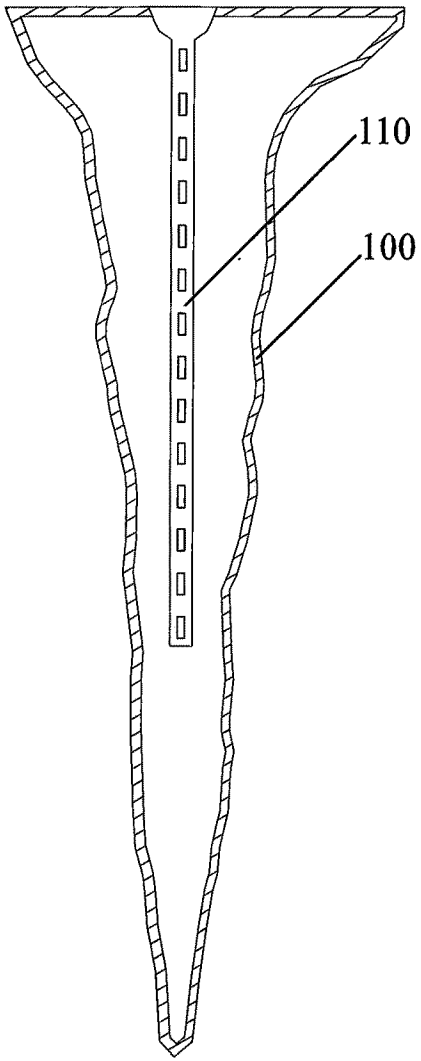
FIG. 25B is a cross-sectional view of the light of FIG. 25A.
Figure 25A:
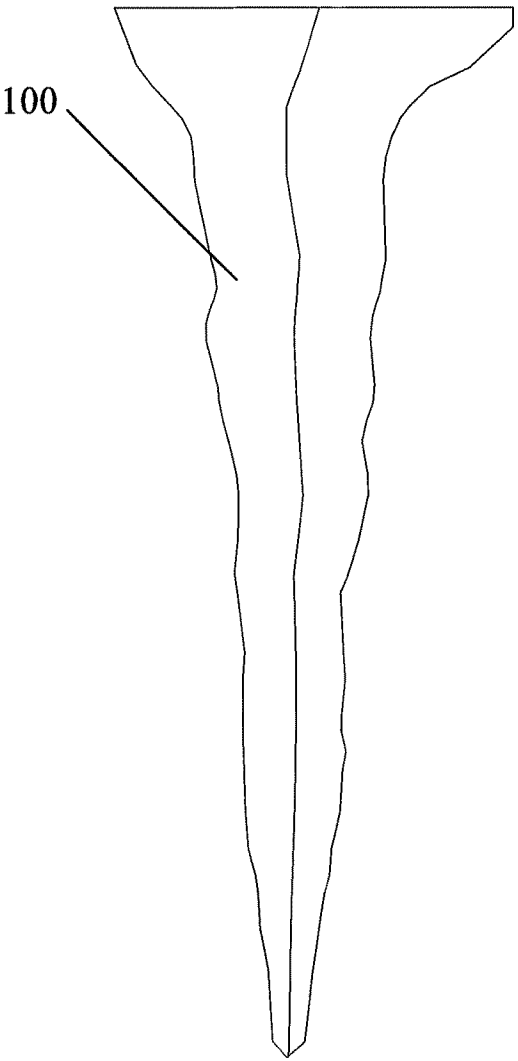
FIG. 25A is an enlarged view of one of the lights of the preceding figures.

FIG. 25A is an enlarged view of one of the lights 100 of the preceding figures. FIG. 25B is a cross-sectional view of the light 100 of FIG. 25A.

Referring to FIGS. 21-25B, the lights 100 can have decorative shapes, such as an icicle shape. Inside can be a plurality of lights 110, such as light emitting diodes (LEDS) and the like. The lights 110 can be white and/or include different decorative colors, such as but not limited to red, blue, yellow, green, and the like.

Figure 26:
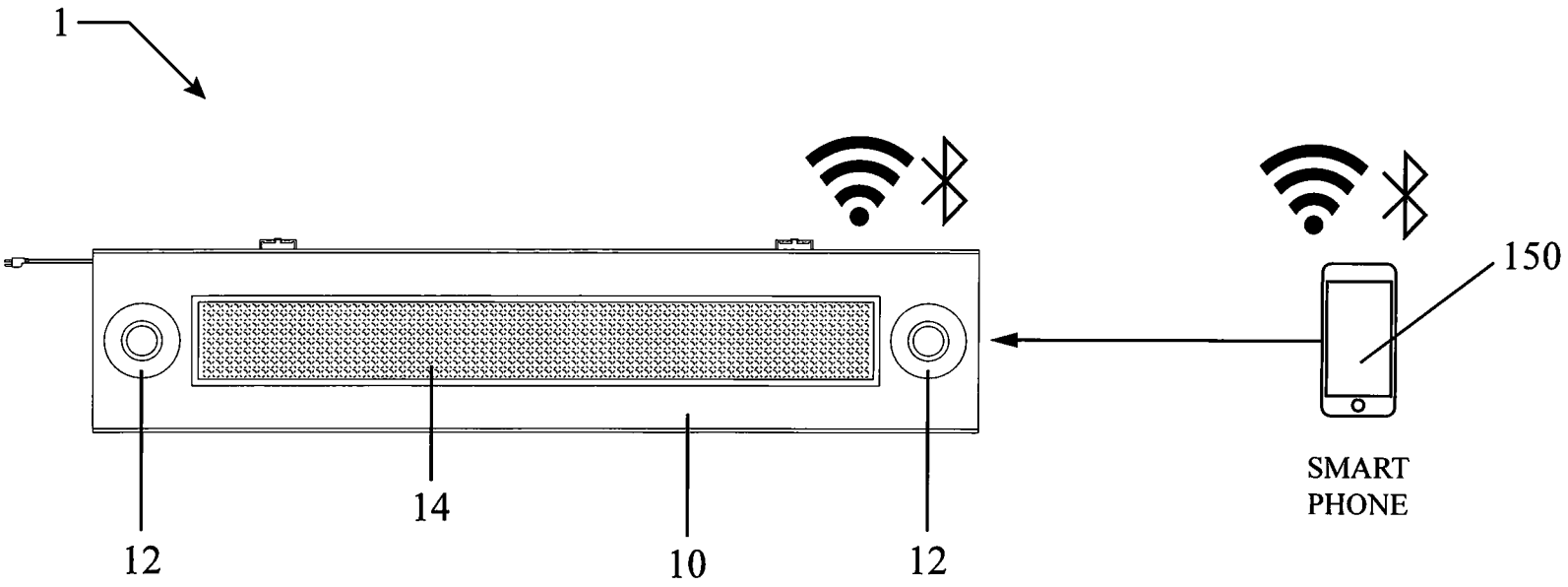
FIG. 26 shows the retractable lights housing of the preceding figures with a smart phone control.
Figure 27:
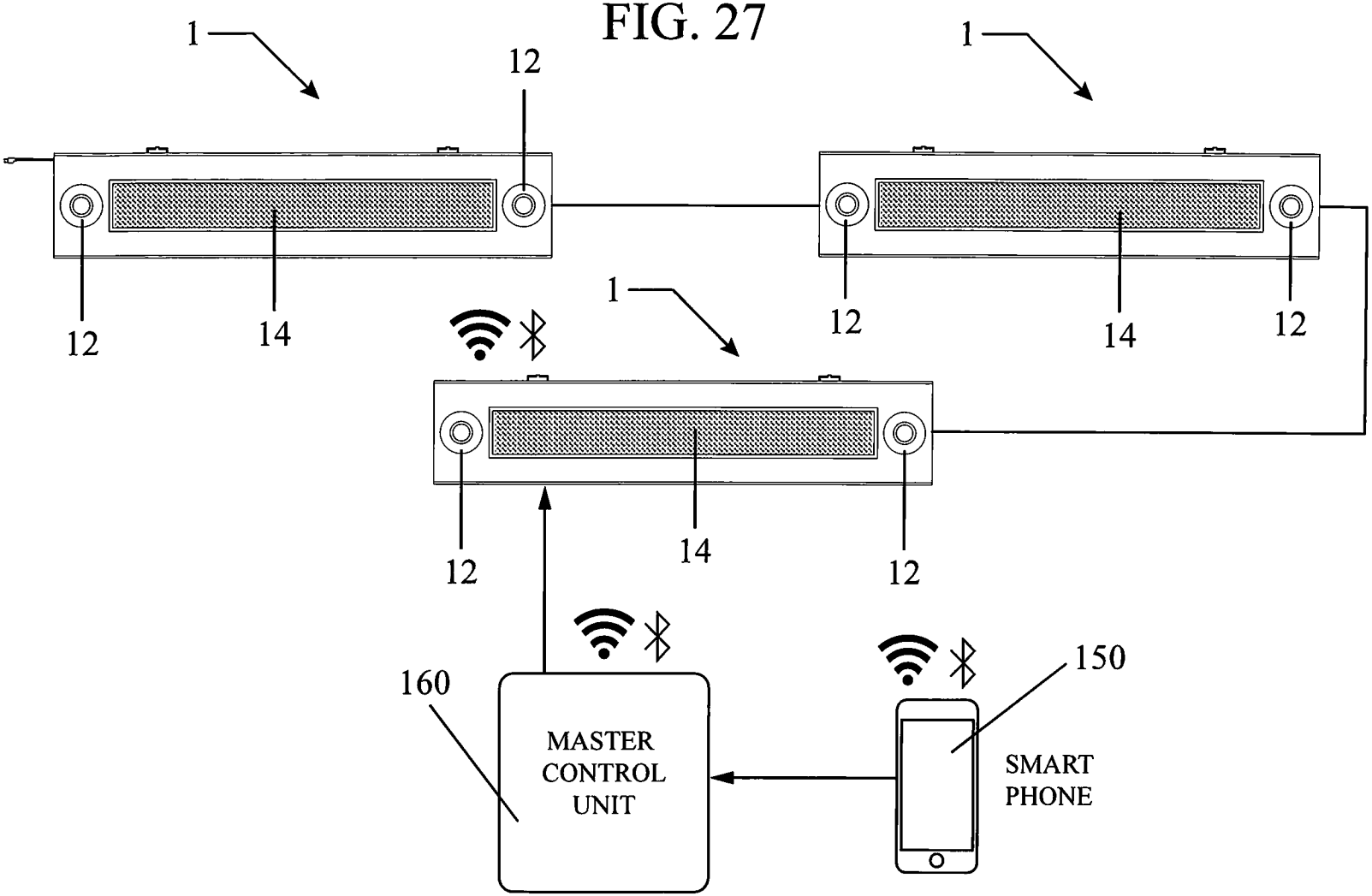
FIG. 27 shows a plurality of retractable lights housings of the preceding figures with a smart phone control.

FIG. 26 shows the retractable lights housing 1 of the preceding figures with a smart phone control 150. FIG. 27 shows a plurality of retractable lights housings 1 of the preceding figures with a master control unit 160 and smart phone 150.

Referring to FIGS. 21-27, the retractable light housing(s) 1 can be operated remotely, such as but not limited to a smart phone 150 and the like. A series of retractable light housing (s) 1 can be connected in series which can each be separately remotely controlled by a master control unit 160 which can be remotely controlled by a smart phone 150. The lights 100 can be supported by a lower platform 74 having a circuit board thereon, and control of turning the lights on and off and operating both the speakers 12 and display 14 can be operated remotely using connections, such as but not limited to WI-FI and the like.

The display 14 can display selected messages, such as but not limited to Merry Christmas, Happy New Year, Happy Birthday, and the like. The speaker(s) 12, can play selected music, such as but not limited to holiday music and the like, that can be downloaded from the web or from a smart phone, and the like. The individual lights can light up in sequence with music playing on the speakers.

The controls for the smart phone 150 for the lights 100 and speakers 12 can be similar to those shown and described in U.S. Patent Application Publications: 2014/0091719 to Tsai; 2016/0215971 to Silver et al.; 2015/0102731 to Altamura et al., and U.S. Pat. No. 6,984,944 to Garrity, which are all incorporated by reference in their entirety. The display 14 can include message displays, such as those shown and described in U.S. Pat. No. 7,825,790 to Tallinger, which is incorporated by reference in its' entirety.

Figure 28A:
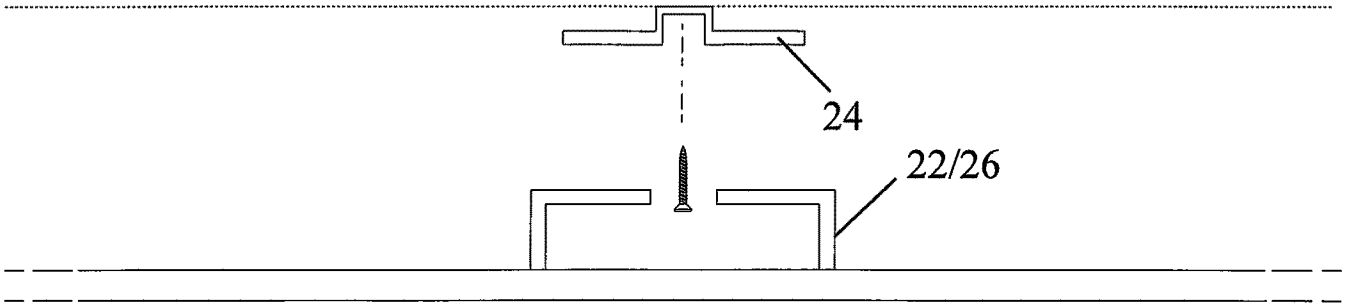
FIG. 28A is an exploded side view of the mounting hardware that can be used to support the retractable lights housing.
Figure 28B:
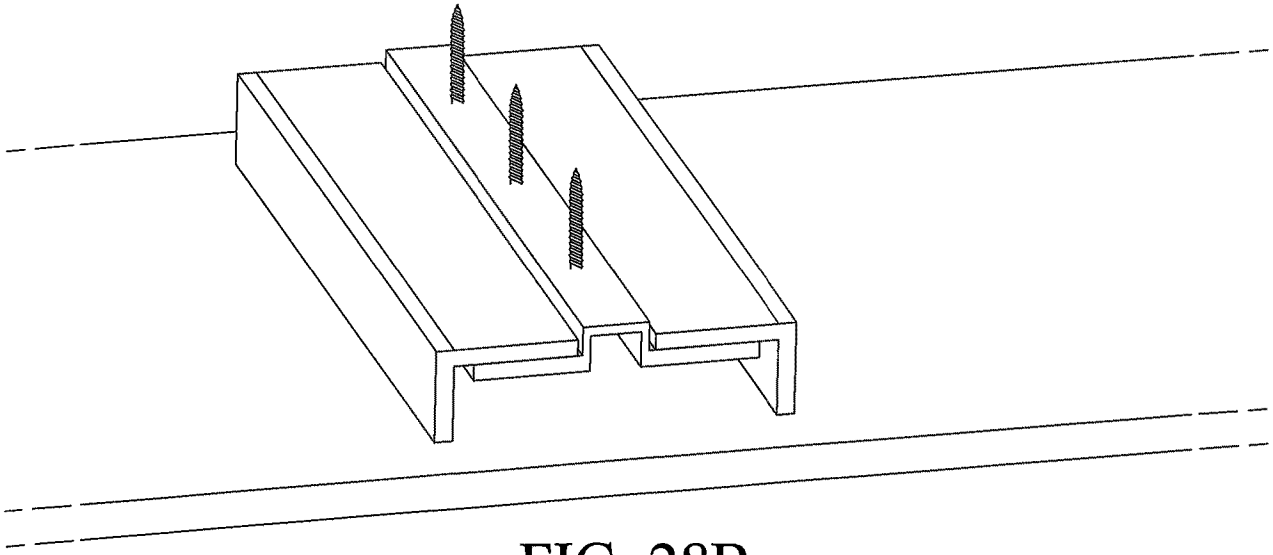
FIG. 28B is a perspective view of mounting hardware of FIG. 26A assembled.

FIG. 28A is an exploded side view of the mounting hardware 22/26 and 24 that can be used to support the retractable lights housing 1. FIG. 28B is a perspective view of mounting hardware 22/26 and 24 of FIG. 26A assembled.

Figure 29:
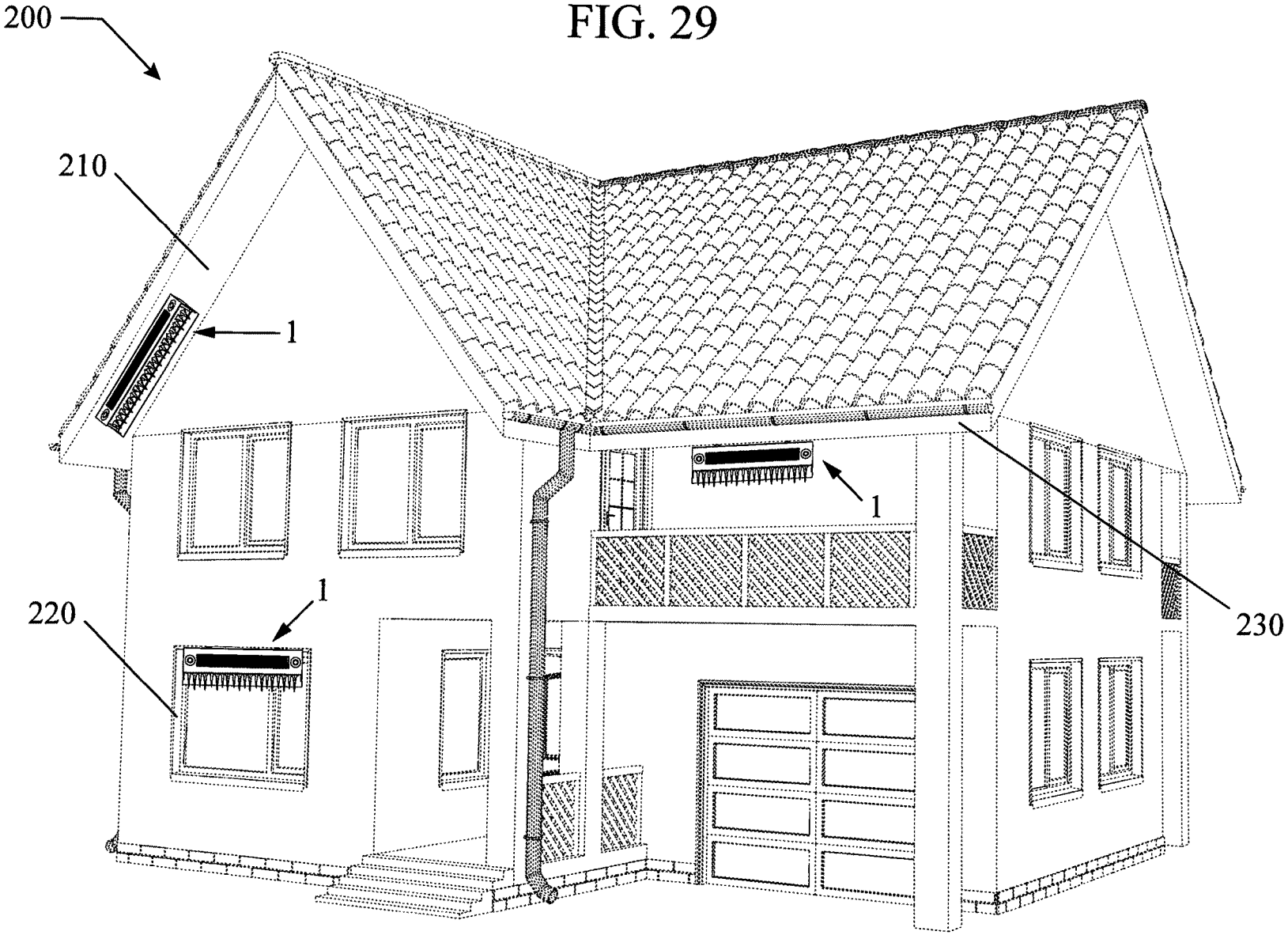
FIG. 29 is a perspective view of a house with a plurality of the retractable lights housings of the preceding figures mounted adjacent to windows and under an overhanging eave.

FIG. 29 is a perspective view of a house 200 with a plurality of the retractable lights housings 1 of the preceding figures mounted adjacent to windows 220 and under an eave 210 and/or overhang 230.

Referring to FIGS. 28A-29, the retractable light housing(s) 1 can be mounted in multiple locations, where the base mount 24 is attached to a structure, such on an eave 210, on top of a window 220 and/or under an overhang 230. The top mounts 22/26 which are pre-attached to the top of the housings 1 can be slide sideways over the pre-attached base mounts 24.

The retractable lights housing 1 can be weatherproofed and sealed to eliminate any water seepage inside. The bottom panel/door 60 can also have seals when closed to eliminate any small animals, such as but not limited to squirrels and the like, birds, and the like, or insects from entering inside when the bottom panel/door 60 is in a closed position.

The easy attachable mounts 22/26 and 24 allows for the retractable lights housing to be easily installed when needed in a short time and allows the housing 1 to be easily removed and stored away.

Although the display 14 is described for having messages, such as holiday greetings, birthday greetings, and the like, other types of messages can be displayed. For example, the display can provide information for first responders, such as but not limited to fireman, paramedics, police, and the like, by having messages, such as but not limited to "HELP", "SEND HELP", "FIRE", "MEDICAL EMERGENCY" and the like. The display can also generate the house address so that the house 200 is easy to locate in the dark or during bad weather conditions.

While FIG. 29 shows the retractable lights housing 1 outside of a window 220, the retractable lights housing 1 can be mounted inside of the window 220 on the inside of the building 200.

Although the preferred embodiment is described using electric power from a wall type power supply, the power can be generated through solar panels, and the like, and the power then stored on batteries 98, when needed.

While the preferred embodiment shows the lights 100 to be shaped like icicles, the lights can have other shapes, such as candles, candy canes (with stripes), balls, and other geometrical shapes, and the like.

Although the preferred embodiment describes the use of a motor to lower and raise the lights, springs can be used, such as those used in window shades, and the like. The pullable window shade can be such as that shown and described in U.S. Pat. No. 4,009,745 to Erpenbeck, which is incorporated by reference in its' entirety.

The term "approximately" can be +/−10% of the amount referenced. Additionally, preferred amounts and ranges can include the amounts and ranges referenced without the prefix of being approximately.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A retractable lighting system, comprising:

a box having a top, front, left side, right side, back and bottom;

a guide on at least one inside wall of the box;

a moveable frame being raiseable and lowerable along the guide;

a plurality of spaced apart lights attached to and extending below the moveable frame, wherein the moveable frame with the plurality of the lights is moveable from a stored position with both the frame and the plurality of the lights inside the box to an extended position with the plurality of lights extending below the box by sliding the moveable frame along the guide;

a cable spool mounted inside of the box;

a cable having an inner end wound about the spool and at least one outer end attached to the moveable frame; and a motor mounted inside the box for rotating the spool to wind the cable about the spool or unwind the at least one outer end of the cable from the spool in order to lower and raise the moveable frame;

at least one rail pulley mounted inside the box above the moveable frame for allowing the cable to ride thereon.

2. The retractable lighting system of claim 1, wherein the box includes:

at least one speaker.

3. The retractable lighting system of claim 2, further comprising:

a remote controller for remotely turning on and off the plurality of the lights, and for operating the at least one speaker.

4. The retractable lighting system of claim 3, wherein the remote controller includes: a smart phone.

5. A retractable lighting system, comprising:

a box having a top, front, left side, right side, back and bottom panel;

a guide on at least one inside wall of the box;

a moveable frame being raiseable and lowerable along the guide;

a plurality of spaced apart lights attached to and extending below the moveable frame, wherein the moveable frame with the plurality of the lights is moveable from a stored position with both the frame and the plurality of the lights inside the box to an extended position with the plurality of lights extending below the box by sliding the moveable frame along the guide;

the bottom panel includes:

a hinge for dropping the bottom panel downward away from the front when the plurality of the lights is being lowered to the extended position;

a motor inside of the box;

a cable spool mounted inside of the box;

a cable having an inner end wound about the spool and at least one outer end attached to both the moveable frame and the hinged bottom panel, wherein the motor rotates the spool to wind the cable about the spool or unwind the at least one outer end of the cable from the spool in order to lower and raise the moveable frame.

6. A retractable lighting system, comprising:

a box having a top, front, left side, right side, back and bottom;

a guide on at least one inside wall of the box;

a moveable frame being raiseable and lowerable along the guide;

a plurality of spaced apart lights attached to and extending below the moveable frame, wherein the moveable frame with the plurality of the lights is moveable from a stored position with both the frame and the plurality of the lights inside the box to an extended position with the plurality of lights extending below the box by sliding the moveable frame along the guide; and, wherein the front includes:

a display for displaying 3*h* wing text messages.

7. The retractable lighting system of claim 6, wherein the moveable frame includes:

a panel with a notched end for the guide members.

8. The retractable lighting system of claim 6, wherein the plurality of the lights includes:

a row of downwardly extending rigid lights.

9. The retractable lighting system of claim 6, wherein the downwardly extending lights include:

icicle shaped lights.

10. The retractable lighting system of claim 6, wherein the box includes:

at least one speaker.

11. The retractable lighting system of claim 6, further comprising:

a remote controller for remotely turning on and off the plurality of the lights.

12. The retractable lighting system of claim 6, further comprising:

a remote controller for remotely turning on and off the plurality of the lights, and for displaying the text messages.

13. The retractable lighting system of claim 9, wherein each of the icicle shaped lights include light emitting diodes (LEDs).

14. The retractable lighting system of claim 10, further comprising:

a remote controller for remotely turning on and off the plurality of the lights, and for displaying the text messages and for operating the at least one speaker.

15. The retractable lighting system of claim 11, wherein the remote controller includes: a smart phone.

16. The retractable lighting system of claim 12, wherein the remote controller includes: a smart phone.

17. The retractable lighting system of claim 14, wherein the remote controller includes: a smart phone.

18. A retractable lighting system, comprising:

a housing having a top, front, left side, right side, back and bottom;

a plurality of retractable lights being moveable from a stored position inside the housing to an extended position substantially extending below the housing; and a display on the front of the housing for displaying text messages.

* * * * *